United States Patent [19]

Seifert

[11] 4,344,575

[45] Aug. 17, 1982

[54] FUEL INJECTION NOZZLE FOR INTERNAL COMBUSTION ENGINES

[75] Inventor: Kurt Seifert, Esslingen-Zollberg, Fed. Rep. of Germany

[73] Assignee: Robert Bosch GmbH, Stuttgart, Fed. Rep. of Germany

[21] Appl. No.: 210,638

[22] Filed: Nov. 26, 1980

Related U.S. Application Data

[63] Continuation of Ser. No. 24,818, Mar. 28, 1979, abandoned.

[30] Foreign Application Priority Data

Jun. 14, 1978 [DE] Fed. Rep. of Germany ..... 2825982

[51] Int. Cl.[3] ..... B05B 1/30

[52] U.S. Cl. ..... 239/533.5; 267/168

[58] Field of Search ..... 239/453, 533.2–533.12; 293/137; 267/168

[56] References Cited

U.S. PATENT DOCUMENTS

| | | | |
|---|---|---|---|
| 2,154,875 | 4/1939 | Streby | 239/453 |
| 3,363,925 | 1/1968 | Olszewski | 293/137 |
| 3,862,751 | 1/1975 | Schwaller | 267/168 X |
| 4,148,469 | 4/1979 | Geyer | 267/168 X |

FOREIGN PATENT DOCUMENTS

| | | | |
|---|---|---|---|
| 499937 | 5/1930 | Fed. Rep. of Germany | 239/533.7 |
| 329505 | 4/1958 | Switzerland | 239/533.5 |

*Primary Examiner*—Robert B. Reeves
*Assistant Examiner*—Gene A. Church
*Attorney, Agent, or Firm*—Edwin E. Greigg

[57] ABSTRACT

A fuel injection nozzle is proposed having a valve needle which opens in the direction of fuel flow and a throttle point controlled in accordance with the stroke of the valve needle which is loaded by at least two closing springs, in order to obtain a distinct pressure jump with respect to the required opening pressure when the throttle point is rendered ineffective. As a result, the throttle point is fully effective during idling and at relatively low partial loads and is only rendered ineffective when the supply of fuel is relatively great.

4 Claims, 4 Drawing Figures

FUEL INJECTION NOZZLE FOR INTERNAL COMBUSTION ENGINES

This is a continuation of application Ser. No. 24,818 filed Mar. 28, 1979 now abandoned.

CROSS-REFERENCE to RELATED DISCLOSURES

This application is related to assignee's copending U.S. application of GERHARD STUMPP ET AL., Ser. No. 24,491 filed Mar. 27, 1979 in Group 313, now abandoned, which application is incorporated herein by reference.

BACKGROUND OF THE INVENTION

The invention relates to a fuel injection nozzle of the type disclosed hereinafter. As a result of the type of throttle point used to control the fuel flow, a lengthening of injection time and thereby quieter operation of the internal combustion engine at small injection quantities is obtained. Furthermore, since it becomes possible to inject small fuel quantities, the fuel is better prepared, which produces a reduction of the specific fuel consumption as well as a substantial reduction of the toxic components in the exhaust gas. At larger injection quantities, that is, in the partial and full load range, the throttle point is made ineffective, whereby sufficient fuel preparation ensues despite the larger flow-through cross section, without any resultant throttle losses. Stringent requirements are placed on the developers of injection systems of this type by engine manufacturers and manifold solutions are already known. These known fuel injection nozzles have the disadvantage, however, that making the throttle point ineffective during the opening stroke is more or less solely dependent upon the quantity of fuel supplied. Even small differences in the force of the closing spring, such as those resulting from fatigue after a period of use, cause a postponement of the quantity-dependent instant upon which the throttle point is made ineffective. This produces substantial disadvantages for the fuel preparation as well as with respect to fuel consumption and quiet engine operation.

OBJECT AND SUMMARY OF THE INVENTION

The fuel injection nozzle in accordance with the invention has the advantage over the prior art that in order to reduce the effectiveness of the throttle point, a distinct pressure jump in the pressure of the fuel supplied is required. This pressure threshold prevents the throttle point from being made prematurely ineffective when there are small or minute irregularities in the fuel supply per unit of time or in the supply pressure, or when the closing spring force is changed.

The invention will be better understood as well as further objects and advantages thereof become more apparent from the ensuing detailed description of three preferred embodiments taken in conjunction with the drawings.

DESCRIPTION OF THE PREFERRED EMBODIMENTS

Figure 1:
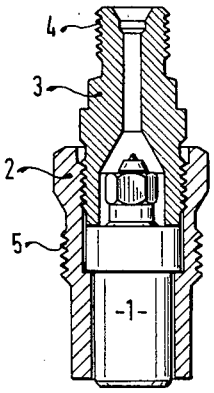
FIG. 1 shows in cross section the basic structure of a fuel injection nozzle in accordance with the invention.

As is shown in FIG. 1, a nozzle body 1 is clamped to a nozzle holder 3 by means of a sleeve nut 2. On the side remote from the nozzle body 1, the nozzle holder 3 has a threaded area 4, onto which the fuel pressure line (not shown) can be attached via a nipple. The sleeve nut 2 has an exterior thread 5, with which it can be threaded into a bore of the internal combustion engine in order to firmly secure the fuel injection nozzle to the engine.

Figure 2:
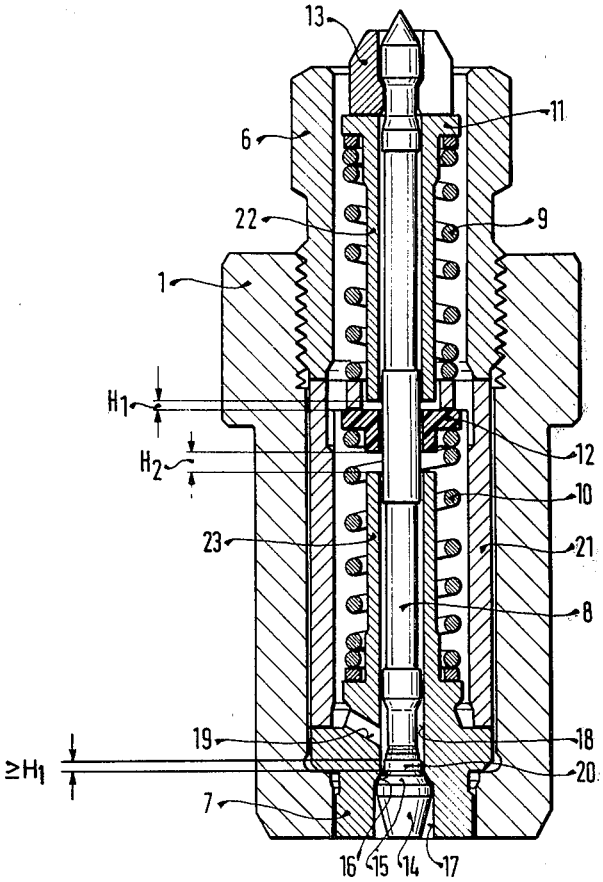
FIGS. 2, 3 and 4 show in cross-sectional views three different exemplary embodiments.

In FIG. 2, the first exemplary embodiment of the invention is illustrated by showing a cross-sectional view through the nozzle body 1. As is clearly shown, an insert 7 is firmly clamped within this nozzle body 1 by means of a hollow screw 6 and an intervening sleeve 21. The insert 7 is part of a valve group now to be described, which can be installed preassembled as a unit. This valve group comprises a valve needle 8, two closing springs 9 and 10, spring plates 11 and 12, and a counter support 13 for the closing spring which engages one end of the valve needle 8. The valve needle 8 has a head 14, which has a conical area 15 which is directed toward the needle shaft and the needle valve opens in the direction of flow against the spring force. Also, this conical area 15 is arranged to cooperate with a valve seat 16 provided on the insert 7, which is disposed as a transitional area between an injection port 17 and a guide bore 18 within the insert 7. The counter support 13 is secured on the end of the valve needle 8 remote from the head 14 in a known manner in order to absorb and transmit the spring forces onto the valve needle 8. The fuel which flows in under pressure acts upon the valve needle 8 and displaces it against the force of the springs 9 and 10 respectively, so that the conical area 15 moves away from the valve seat 16 and the injection takes place via the bore 17. After the termination of the supply of fuel under pressure, the conical area 15 is pressed back onto the seat 16 by the springs 9 and 10, respectively. The fuel flows during injection through a bore 19 provided in the insert 7 to the guide bore 18 of the insert 7, and from there, as already described, is directed between the valve needle conical area 15 and the valve seat 16 to the injection port 17.

Adjacent to the conical area 15 on the valve needle is a shoulder 20, which together with the bore 18 defines an annular gap. The fuel that flows via the bore 19 must therefore pass first through this annular gap, which acts as a throttle point, in oder to reach the injection port 17. Thus, as a result of this throttle point, the throttling procedure which is required at each fuel injection nozzle for preparing, that is, atomizing, the fuel is increased. This throttle point is particularly advantageous when the quantity of fuel supplied per unit of time is relatively small, such as during idling and at lower partial-load range. When the valve needle 8 has performed the stroke indicated as $H_1$, the shoulder 20 emerges from the bore 18, which eliminates this supplementary throttling effect, that is to say, the throttle is no longer effective. This always occurs when the throttle point would have an undersirably great throttling effect as a result of the larger fuel quantity supplied per unit of time, such as at partial load and at full load. The invention is not limited to throttle points which are disposed immediately upstream of the valve seat. However, the illustrated example is favorable, because the throttle point upstream of the seat does not become soiled from carbonization.

To control the action which decreases the effectiveness of the throttle point in a distinctly pressure-dependent manner, and, further, in order thus to obtain a distinct pressure jump between smaller and larger fuel quantities, two springs 9 and 10 are selected which come into engagement one after the other. The spring 9 is supported on a spring plate within a sleeve 21, and through the means of which the insert 7 is clamped firmly onto the nozzle body 1 by means of the hollow threaded body 6. In addition, it will be noted that spring 9 encompasses a sleeve 22 which is provided with an annular flange 11 that provides an abutment for the opposite end of spring 9. By this design construction and by reason of the length of the sleeve 22 it will strike the upper surface of the annular support member 12, which forms an abutment for the closing spring 10, after the stroke $H_1$ has been performed. The spring 10 is compressed by the spring support plate 12 only after the valve needle 8 is displaced farther and when the pressure of the supplied fuel rises further. Since the spring 9 is supported in a stationary manner, now both springs act in the closing direction after the desired pressure jump has taken place. After the stroke path $H_2$ has been covered, then the collar of the spring supporting plate 12 strikes a tubular body comprising a stop 23 that is integral with the insert 7. This determines the maximum opening of the injection valve, so that the throttle cross-sectional area of passage required for the limitation of the injection quantity is constantly maintained.

Figure 3:
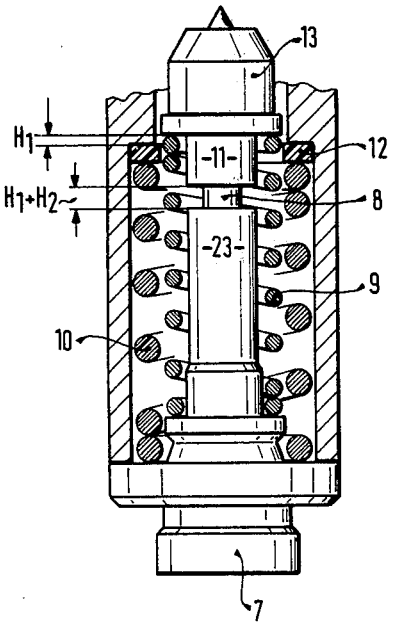

In the second exemplary embodiment of this invention illustrated in FIG. 3, the closing springs 9 and 10 are disposed in mutually coaxial relationship. They are both supported on the insert 7. During the throttle opening stroke $H_1$, only the spring 9 is effective. During the further opening stroke, then the spring supporting plate 12 provided for the spring 10 is carried along by means of the annular element 11 that forms a support for the spring 9, which thus produces the desired pressure jump. After the total stroke $H_1$ plus $H_2$, the collar of spring supporting plate or element 11 strikes the stop 23, thereby determining the maximum opening stroke.

Figure 4:
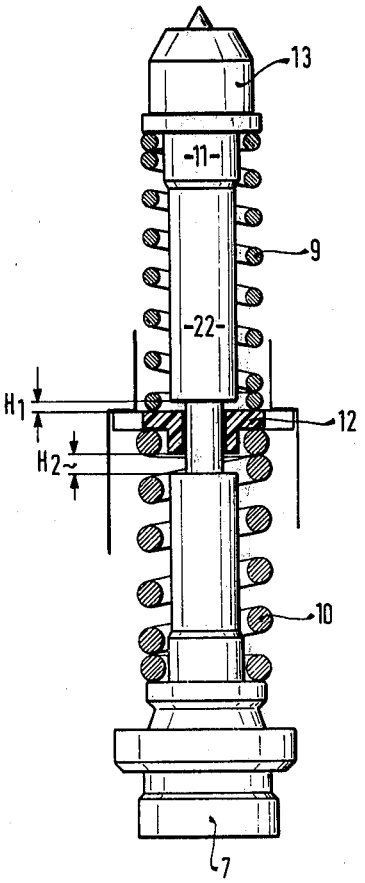

In the third exemplary embodiment of this invention shown in FIG. 4, the spring 9 rests with its side remote from its spring supporting plate 11 on the spring plate 12. However, the spring 9 is embodied as softer or more flexible than the spring 10, so that the spring plate 12 is only displaced against the force of the spring 10 when the stop sleeve 22 strikes this spring supporting plate 12 after the throttling stroke $H_1$ has been performed. In principle, however, this example operates in the same manner as that shown in FIG. 2. Also, the spring supporting plate 12 is provided with a crenellated perimeter to permit full flow therepast.

The invention is not solely limited to fuel injection nozzles having valve needles which open outward, but rather it is applicable in general for needles opening in the direction of flow, in which, for example, a front plate including an injection port is disposed downstream of the needle head on the injection side. The invention is also relevant to fuel injection nozzles in which the valve needle is exclusively shaft-like in embodiment.

The foregoing relates to three preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines comprising a nozzle body, a bore in said nozzle body, an insert including a valve seat disposed in said nozzle body on an outer end of said bore, said insert including a tubular body extension, a valve needle guided by said tubular body extension, said valve needle having a terminal head portion which cooperates with said valve seat for fuel passage, said valve needle adapted to open in the fuel flow direction against the force of a closing spring means, said valve needle further including an annual cylindrical shoulder positioned upstream of said terminal head portion in cooperation with said tubular body extension to form a throttle point for controlling fuel flow in accordance with the stroke of said valve needle, said throttle point being effective in an initial opening stroke and subsequently made ineffective, said valve needle further being arranged to be loaded by said closing spring means, said closing spring means including at least two mutually associated prestressed closing springs for causing a sudden increase in closing force of said valve needle subsequent to an initial opening stroke, each of said closing springs being supported in axial alignment in a stationary manner on one end thereof, and said valve needle head portion cooperates with said valve seat for predetermining the initial position of said closing springs.

2. A fuel injection nozzle in accordance with claim 1, further wherein one of said two closing springs is operative during said initial opening stroke ($H_1$) and, another of said two springs being operative during a further valve needle stroke ($H_2$).

3. A fuel injection nozzle in accordance with claim 1, further wherein said at least two closing springs have different spring contants and are actuated in series with one spring softer than the other the softer of said springs is compressed during the initial opening stroke ($H_1$) with the other spring being compressed during further opening of the stroke.

4. A fuel injection nozzle in accordance with claim 3, further wherein the actuation of the stiffer of said springs takes place via a coupling part, which when the valve needle lifts after the initial opening stroke ($H_1$) engages a spring supporting plate for said stiffer spring.

* * * * *